United States Patent [19]

Ver Hage

[11] 4,037,746

[45] July 26, 1977

[54] PLASTIC CAP AND BOTTLE NECK

[75] Inventor: Richard P. Ver Hage, North Haledon, N.J.

[73] Assignee: GSF Corporation, Hawthorne, N.J.

[21] Appl. No.: 695,266

[22] Filed: June 11, 1976

[51] Int. Cl.[2] ..... B65D 41/46

[52] U.S. Cl. ..... 215/31; 215/256; 215/321

[58] Field of Search ..... 215/31, 256, 321; 220/270

[56] References Cited

U.S. PATENT DOCUMENTS

| | | | |
|---|---|---|---|
| 1,582,681 | 4/1926 | Hammer | 215/31 X |
| 2,886,198 | 5/1959 | Herter | 215/31 |
| 3,338,446 | 8/1967 | Faulstich | 215/256 X |
| 3,434,613 | 3/1969 | Langecker | 215/256 |
| 3,672,528 | 6/1972 | Faulstich | 215/256 |

FOREIGN PATENT DOCUMENTS

| | | | |
|---|---|---|---|
| 2,152,353 | 4/1973 | Germany | 215/319 |
| 257,573 | 2/1927 | United Kingdom | 215/31 |

*Primary Examiner*—Donald F. Norton

[57] ABSTRACT

A plastic cap is adapted for use with a bottle neck having two spaced grooves formed in the outer surface thereof the upper one of said grooves being spaced from the top edge of the neck so as to define smooth sealing surfaces above, between and below said grooves. The cap has a pair of inwardly directed circumferential beads formed on an inner surface of a thin-walled skirt that depends from a disc-shaped top of the cap. The beads are positioned so that they fit in the grooves when the cap is in place on the neck and form an interference fit with the edges of the grooves to prevent inadvertent removal of the cap. The beads are of such a size that they do not fill the grooves thereby allowing for a large contact area between the inner skirt surface and the sealing surfaces of the neck. A circumferential score line is formed about the skirt between the beads and connects with a spiral score line extending to the bottom edge of the cap adjacent to an upper side of a horizontal tear tab formed at the bottom edge of the skirt, said tear tab being partially connected to the bottom edge of the skirt by a short horizontal continuation of the score line.

3 Claims, 5 Drawing Figures

PLASTIC CAP AND BOTTLE NECK

BACKGROUND OF THE INVENTION

1. Field of the Invention

This invention relates to bottle closures and more particularly to a bottle neck structure and a plastic cap adapted to fit on said neck with improved sealing capability.

2. Description of the Prior Art

Plastic caps for narrow necked plastic bottles are typically of the type disclosed in U.S. Pat. No. 3,338,446. The caps have a depending thin-walled skirt weakened approximately midway of its length with a circumferential score line so that the portion of the skirt below the score line may be torn off. The cap has two beads which extend circumferentially around the inside of the cap. These beads fit into the grooves in the bottle neck and prevent the cap from being removed from the container. When both beads are in place the cap cannot be removed thereby preventing any tampering with the bottle contents. The lower bead is torn away when the lower skirt is removed. This then allows the cap to be easily pried over the upper bead to allow access to the contents. The upper bead remains with the cap thereby allowing the cap to be used repeatedly for reclosure until the contents of the bottle are exhausted.

There are several problems with the plastic caps of the prior art. A major problem is the splitting of the lower portion of the cap when it is forced onto bottle neck. The score line for the tear-away lower section extends diagonally through the lower portion of the cap skirt and terminates at its bottom edge. This score line weakens the skirt and when pressure is exerted in an attempt to push the cap onto the bottle, the skirt often tears along the score line. Bottles with torn skirts must be removed from the packaging line, the cap manually removed and the bottle and contents recycled. This tearing problem, referred to as a cap splitting, is a substantial burden and significantly increases operating expenses.

Another problem with the prior art caps is the difficulty by the consumer in tearing the lower skirt from the cap. The problem is caused, in part, by the manufacturer when it strengthens the score line for the purpose of reducing cap "splitting" as discussed above. By strengthening the score line, the amount of force or "difficulty" required to tear the lower skirt from the cap is proportionately increased.

Another problem existant with the prior art caps is the loose fit of the cap onto the bottle. A tight fit between the cap and the bottle is essential for a good seal. Although the prior art caps could be made to fit more tightly on the bottle, such an improvement would result in a greater number of cap splitting. Thus an improvement in fit or seal is off-set by an increase in split caps and operating costs.

In an effort to eliminate the difficulties encountered with splitting caps a design as shown in U.S. Pat. No. 3,927,784 was developed. This design eliminated cap splitting by eliminating the diagonal score line that extended to the bottom edge of the skirt and instead utilized two parallel circumferential score lines that defined a tear strip for separating the lower skirt from the upper skirt allowing the cap to be removed. This structure was fine for single use bottles but proved extremely costly for reusable bottles since the lower skirt portion had to be manually removed prior to reuse substantially increasing operating cost.

Since a good seal is required between the cap and the bottle, the prior art devices used tight fitting beads that completely filled the groove and formed a high pressure line contact type of seal about the groove. This type of seal made removal of the cap difficult and also added to the skirt splitting problem due to the interference between the larger bead and the widest portion of the neck structure.

A need thus exists for a tamper-proof cap which can be used repeatedly for reclosure, which can be inserted onto the bottles without cap splitting, which can be removed from the bottle by the consumer without great difficulty, which has a tight fit or good seal and which is relatively easy to produce and inexpensive to manufacture.

SUMMARY OF THE INVENTION

The present invention contemplates a bottle neck having a structure wherein two spaced grooves are formed in the outer surface thereof, the upper most groove being spaced from the top edge of the neck so that three smooth sealing surfaces above, between and below the grooves are formed. The invention also provides a deformable plastic cap having a top disc, a cylindrical thin-walled outer skirt depending from the disc and a short inner cylindrical skirt depending also from the disc coaxially with the outer skirt. The outer skirt is sized to fit snugly over the outer surface of the neck and the inner skirt is designed to engage the inner surface of the neck.

A pair of spaced inwardly directed circumferential beads are formed on the inner surface of the outer skirt and are positioned to fit in the grooves to form an interference fit with the groove edges thereby preventing inadvertent removal of the cap. The beads are formed so that they are small and do not fill the grooves thereby allowing full contact between the three sealing surfaces and the snugly fitting outer skirt. In this manner a large area of sealing surface is provided without the need for a high contact pressure, small area, seal as in the prior art.

A circumferential score line is formed about the outer skirt between the two beads and is connected to a spiral score line that extends to the bottom edge of the skirt adjacent to an upper side of a horizontal tear tab connected at one end to the bottom edge of the skirt and being further connected at its midportion by a short horizontal continuation of the score line. The horizontal tear tab and score line strengthen the skirt and prevent skirt splitting during installation of the cap while facilitating removal of the cap by providing a tab that may be easily grasped with the fingers.

It is therefore an object of this invention to provide an improved plastic cap.

It is an additional object of this invention to provide an improved plastic cap which does not split when inserted onto a container.

It is a further object of this invention to provide an improved plastic cap which may be removed from the container without difficulty.

Another object of this invention is to provide an improved plastic cap which fits tightly on the container neck and provides improved sealing of the container contents.

It is a further and additional object of this invention to provide a container and improved cap combination.

DESCRIPTION OF THE INVENTION

Cap 10 constructed in accordance with the present invention is preferably made from a thin, resilient and moderately flexible plastic material so that it may deform slightly to snap on and off a bottle neck. The plastic material is preferably polyethylene or polystyrene; however, many other plastics may be successfully used. The cap 10 is designed for use with a bottle neck 12, that has a specific configuration as shown most clearly in FIG. 3. It is contemplated that the bottle and neck 12 will be made with thin-walls preferably of polycarbonate which has ideal characteristics for reusable food containers such as milk bottles. The polycarbonate bottle has the clarity of glass while being light weight and essentially unbreakable.

Figure 3:
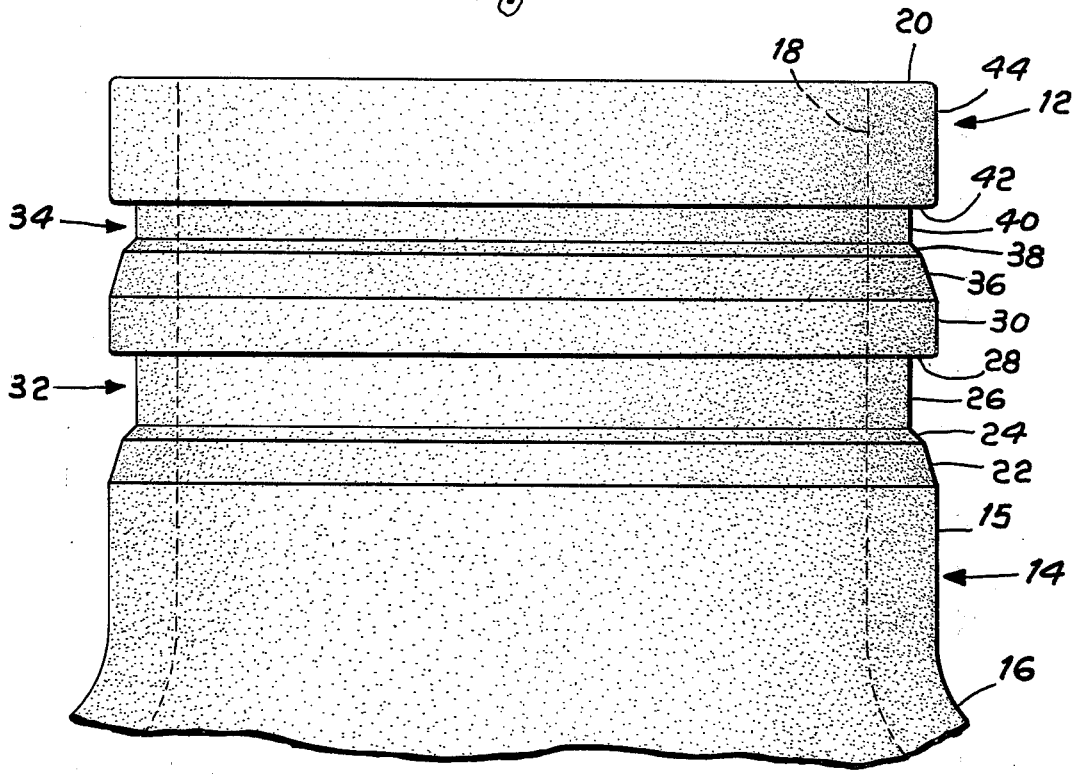
FIG. 3 is a side elevation of a bottle neck constructed in accordance with the present invention.

Referring to FIG. 3 there is shown the preferred configuration of neck 12 which may basically be described as being cylindrical with two spaced grooves. More particularly however the base 14 of neck 12 extends upwardly from the bottle body 16 and has a cylindrical outer sealing surface 15 of a predetermined diameter. The entire inner surface 18 of the neck is a smooth cylindrical surface extending to an upper edge 20 having a flat annular surface. The base 14 merges into a first frustoconical surface 22 forming an angle of approximately 70° with a horizontal plane and surface 22 merges into a second frustoconical surface 24 forming an angle of approximately 30° with a horizontal plane. The second frustoconical surface 24 terminates at a cylindrical surface 26 which extends upwardly to an annular shoulder 28 that extends outwardly to a second cylindrical sealing surface 30 that extends upwardly and has a diameter slightly less than the diameter of surface 15. Surfaces 22, 24, 26 and 28 define a first groove 32 having a depth of approximately 0.045 inch.

A second groove 34 is defined by frustoconical surfaces 36 and 38, cylindrical surface 40 and an annular shoulder 42 similiar to surfaces 22, 24, 26 and 28. Groove 34 has a depth of approximately 0.040 inch and is spaced from groove 32 by second sealing surface 30. Annular shoulder 42 terminates in a third cylindrical sealing surface 44 that extends upwardly to the upper edge 20. The third cylindrical sealing surface 44 has a diameter that is slightly less than the diameter of surface 30.

Cap 10 has a flat disc top 46 with a depending outer cylindrical skirt 48 and a depending inner skirt 50. The inner skirt has outer surface 52 that terminates in a slight bevel 54 for ease of application of the cap 10 onto neck 12 of the bottle. The space between the outer surface 52 of the inner skirt and the inner surface 56 of the outer skirt 48 is slightly less than the thickness of neck 12 so that surfaces 52 and 56 fit snugly against surfces 18 and 44 respectively and thereby form sealing surfces. Outer skirt 48 has a length that is sufficient to extend below groove 32 and over surface 15. Since surfaces 30 and 15 have increasing larger diameters the inner surface 56 of the cap fits snugly against each of these sealing surfaces so that a total of four large area sealing surfaces are provided, one on the inside of the neck and three on the outside.

Figure 4:
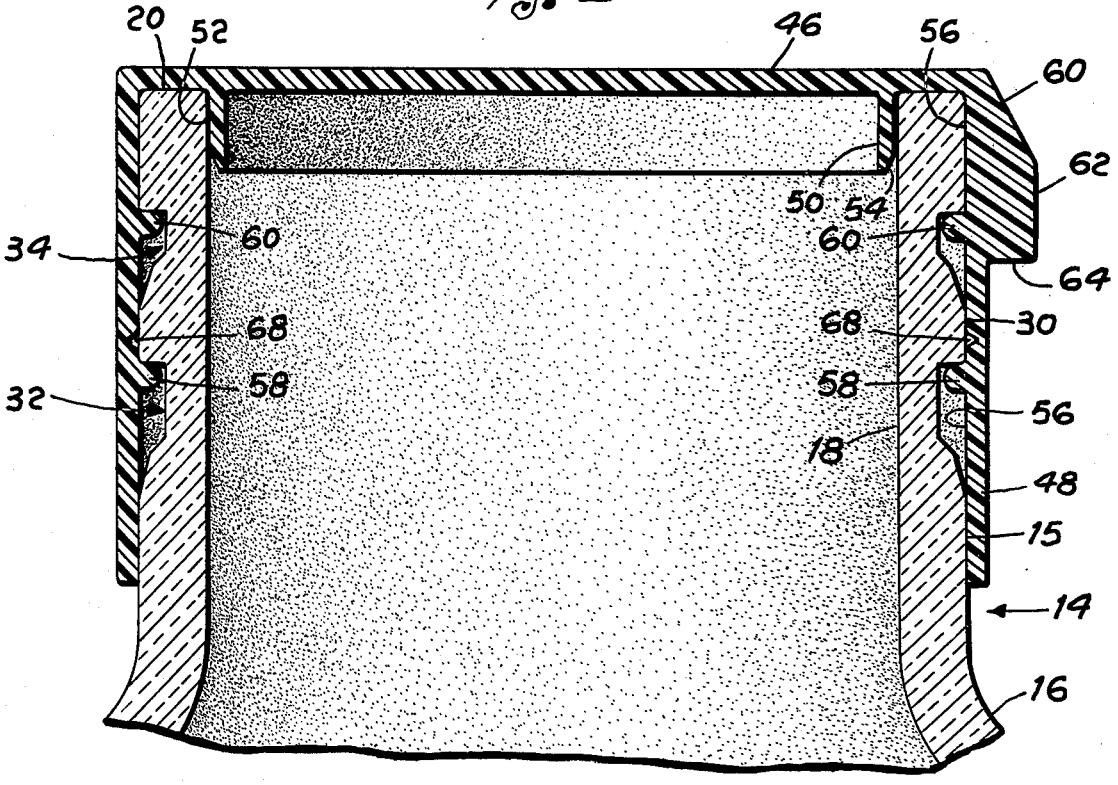
FIG. 4 is a vertical section showing the cap of FIG. 2 on the neck of FIG. 3.

Formed on surface 56 are two inwardly directed circumferential beads 58 and 60 of semicircular crossection. Said beads are disposed to fit in grooves 32 and 34 when the cap is in place on the neck as shown in FIG. 4. The shape of the beads is not critical; however, the size is important. The beads must be of such a size that they form a interference fit with shoulders 28 and 42 to prevent inadvertent removal of the cap from the bottle neck but the beads must be smaller than the grooves so that the grooves are not filled and the beads do not bottom out in the grooves. If the beads were to bottom out in the grooves the snug fit between surface 56 and surfaces 15, 30 and 44 would be broken and the seals would be ineffective. Thus, the beads only serve to lock the cap on, but do not serve any sealing function in this way large area low pressure sealing is facilitated and effective sealing can be realized without a tight fit that could lead to skirt splitting and make opening difficult.

To facilitate removal of the cap from the neck a finger hold 62 is molded as part of the cap. Finger hold 62 has a flat bottom 64 and a slanted top 66 and a rectangular shape in a horizontal plane. The finger hold 62 extends outwardly from the skirt 48 so that a user may press a thumb or finger against surface 64 to pry the cap off the neck.

Figure 1:
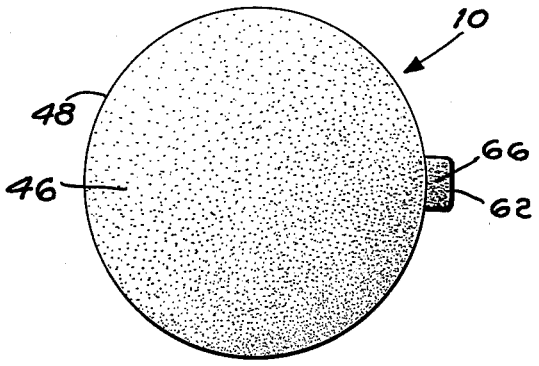
FIG. 1 is a top view of a cap constructed in accordance with the invention.
Figure 2:
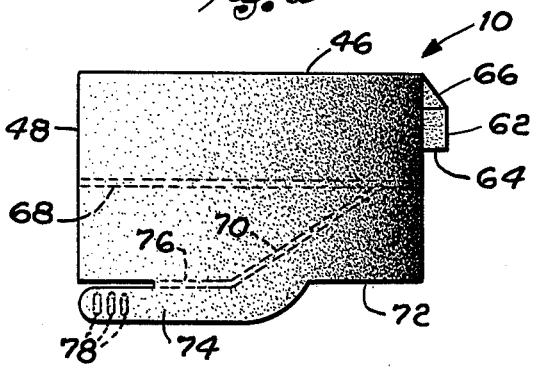
FIG. 2 is a side elevation of the cap of FIG. 1.
Figure 5:
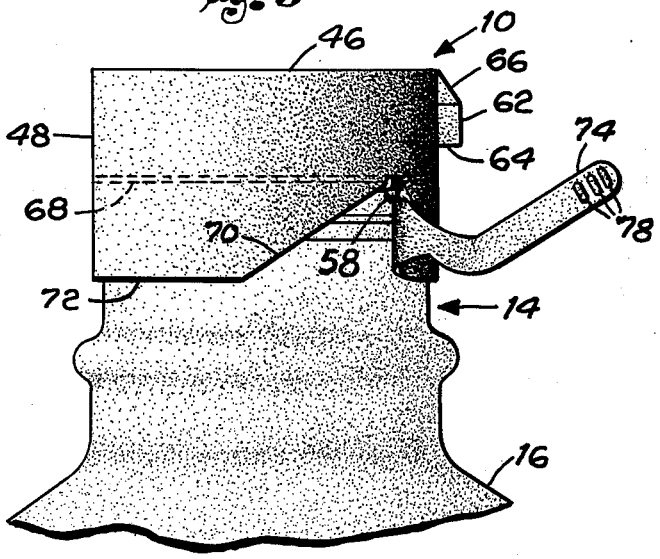
FIG. 5 is a partial side elevation of a cap and bottle neck showing partial tearing of the skirt.

When the cap is in place on the neck initial removal is difficult due to the interference fit between beads 58 and 60 and shoulders 28 and 42. In order to facilitate removal means are provided to remove the lower portion of skirt 48 including bead 58. An internal circumferential groove or score line 68 is formed in surface 56 between beads 58 and 60. This groove could also be formed on the external surface of skirt 48 with the same result. A diagonal or spiral score line 70 is connected to score line 68 and extends downwardly to the lower edge 72 of skirt 48. A tear tab 74 is connected at one end to the lower edge 72 and extends horizontally around the edge with a midportion of an upper side being connected to lower edge 72 by a horizontal score line 76. The other end of tear tab 74 is unconnected and has beads 78 formed on an inner surface to facilitate gripping the tab. When tab 74 is pulled upwardly and to the right as shown in FIG. 5 the skirt 48 tears along the score lines 76, 70 and 68 so that the lower portion of skirt 48 including bead 58 is removed. With the lower portion of the skirt removed, the cap may easily be pryed off with slight pressure on surface 64 of finger hold 62. Due to the resilience of the cap material, the cap may easily be snapped back in place to protect unused contents.

Thus, the present invention provides a cap structure that in conjunction with a neck structure facilitates an excellent seal at low pressures so that cap application and removal is not difficult. The cap has four large area sealing surfaces that provide the low pressure seal. Skirt splitting is avoided by the unique use of a horizontally disposed tear tab that functions to reinforce the skirt adjacent the score line and thereby prevent splitting of the skirt during capping. The cap has internal circumferential beads that fit in grooves to prevent inadvertent removal of the cap, but said beads are of such a size so that they do not bottom in the groove thereby allowing full engagement over the large area sealing surfaces. The tear tab is also positioned to be torn by pulling to the right which is more convenient for most people.

What is claimed is:

1. A deformable plastic cap, comprising:

a top;

a substantially cylindrical thin-walled skirt depending from said top;

a pair of spaced internally directed circumferential beads formed on the inner surface of said skirt;

a circumferential score line formed in said skirt between said beads;

a second score line extending from the circumferential score line to a lower edge of said skirt; and a tear tab positioned below the lower end of the second score line and having an upper edge juxtaposed with the lower edge of the skirt, one portion of the upper edge being molded integrally with the skirt on one side of the second score line and a second portion of the upper edge being connected to the lower edge of the skirt on the opposite side of the second score line by a third score line, whereby the tear tab functions to reinforce the skirt adjacent the second score line and reduces skirt splitting during capping.

2. A deformable plastic cap as described in claim 1, additionally comprising an unconnected third portion of said tear tab extending in a circumferential direction from the second portion of the tear tab.

3. A container, comprising:

a body portion;

a substantially cylindrical neck extending upwardly from the body to an upper edge said neck having a substantially cylindrical outer surface;

a pair of spaced circumferential grooves formed in said outer surface of the neck, the upper one of said grooves being spaced from the upper edge of the neck and the lower one of said grooves being spaced from the body portion so that the neck is divided into three separate cylindrical outer surface portions having increasing diameters from the upper most surface portion to the lower most surface portion, each of said grooves being partially defined by an annular surface intersecting the cylindrical outer surface portion farthest from the body portion at a right angle and a frustoconical surface intersecting the cylindrical outer surface portion closest to the body portion.

* * * * *